US012241691B1

(12) United States Patent
Kreuger

(10) Patent No.: US 12,241,691 B1
(45) Date of Patent: Mar. 4, 2025

(54) ENERGY STORAGE AND RETRIEVAL SYSTEMS AND METHODS

(71) Applicant: Sten Kreuger, Chonburi (TH)

(72) Inventor: Sten Kreuger, Chonburi (TH)

( * ) Notice: Subject to any disclaimer, the term of this patent is extended or adjusted under 35 U.S.C. 154(b) by 0 days.

(21) Appl. No.: 18/655,202

(22) Filed: May 3, 2024

(51) Int. Cl.
*F28D 20/00* (2006.01)
*F01K 25/10* (2006.01)
*F01K 23/10* (2006.01)

(52) U.S. Cl.
CPC ..... *F28D 20/0034* (2013.01); *F01K 25/103* (2013.01); *F01K 23/10* (2013.01); *F28D 2020/0078* (2013.01); *F28D 2020/0082* (2013.01)

(58) Field of Classification Search
CPC ..... F28D 20/0034; F28D 2020/0082
See application file for complete search history.

(56) References Cited

U.S. PATENT DOCUMENTS

| | | | |
|---|---|---|---|
| 1,955,261 | A | 1/1932 | Tryon et al. |
| 2,443,295 | A | 5/1944 | Bisch |
| 2,621,903 | A | 12/1952 | Cohler |
| 4,054,124 | A | 10/1977 | Knoos |
| 4,089,744 | A | 5/1978 | Cahn |
| 4,166,361 | A | 9/1979 | Earnest et al. |
| 4,262,657 | A | 4/1981 | McCullough et al. |
| 4,285,203 | A | 8/1981 | Vakil |
| 4,523,637 | A | 10/1985 | Abramo |
| 4,557,112 | A | 12/1985 | Smith |
| 4,827,735 | A | 5/1989 | Foley |
| 4,873,828 | A | 10/1989 | Laing et al. |
| 4,945,010 | A | 7/1990 | Kaufman et al. |
| 5,181,560 | A | 1/1993 | Burn |

(Continued)

FOREIGN PATENT DOCUMENTS

| | | | |
|---|---|---|---|
| CA | 1126523 | | 6/1982 |
| CN | 114199059 A | * | 3/2022 |

(Continued)

OTHER PUBLICATIONS

Machine translation of CN-114199059-A, accessed Sep. 13, 2024. (Year: 2024).*

(Continued)

*Primary Examiner* — Jonathan R Matthias
(74) *Attorney, Agent, or Firm* — Andrew D. Fortney; Central California IP Group, P.C.

(57) ABSTRACT

Energy storage and retrieval systems are disclosed, along with methods of storing and retrieving the energy. One system includes a thermal energy storage subsystem and a trilateral cycle, with first and second heat exchangers. The first heat exchanger exchanges heat between the energy storage medium and the working fluid, and the second heat exchanger exchanges heat between the high- and low-pressure sides of the trilateral cycle. Another system includes a conduit fluidly connecting pressurized gas in low- and high-temperature thermal energy storage tanks and passing through a heat exchanger in which the gas in the conduit exchanges heat with the thermal energy storage medium and/or the working fluid, enabling recovery of heat lost to evaporation of the thermal energy storage medium during discharge of the stored thermal energy in the system. The methods relate to various operations of the systems.

23 Claims, 4 Drawing Sheets

(56) References Cited

U.S. PATENT DOCUMENTS

| | | | |
|---|---|---|---|
| 5,222,298 | A | 6/1993 | Schatz |
| 5,239,833 | A | 8/1993 | Fineblum |
| 5,404,941 | A | 4/1995 | Jacksits |
| 5,441,097 | A | 8/1995 | Kanda et al. |
| 5,720,339 | A | 2/1998 | Glass et al. |
| 7,481,057 | B2 | 1/2009 | Patwardhan |
| 7,637,457 | B2 | 12/2009 | Bennett |
| 7,845,172 | B2 | 12/2010 | Goldman |
| 8,250,847 | B2 | 8/2012 | Rapp et al. |
| 8,443,605 | B2 | 5/2013 | Ruer |
| 8,584,463 | B2 | 11/2013 | Hemrle et al. |
| 8,656,712 | B2 | 2/2014 | Howes et al. |
| 8,739,512 | B2 | 6/2014 | Mills |
| 8,826,664 | B2 | 9/2014 | Howes et al. |
| 9,038,390 | B1 | 5/2015 | Kreuger |
| 2003/0066633 | A1 | 4/2003 | Lee et al. |
| 2005/0103465 | A1 | 5/2005 | Brasz |
| 2008/0219651 | A1 | 9/2008 | Nayef |
| 2010/0276131 | A1 | 11/2010 | Barwig et al. |
| 2010/0301614 | A1 | 12/2010 | Ruer |
| 2010/0307169 | A1 | 12/2010 | Diaz |
| 2011/0100611 | A1 | 5/2011 | Ohler et al. |
| 2011/0139407 | A1 | 6/2011 | Ohler et al. |
| 2011/0286724 | A1 | 11/2011 | Goodman |
| 2012/0060501 | A1 | 3/2012 | Hemrle et al. |
| 2012/0216536 | A1 | 8/2012 | Ma et al. |
| 2013/0087301 | A1 | 4/2013 | Hemrle et al. |
| 2013/0111903 | A1 | 5/2013 | Stiesdal |
| 2013/0147197 | A1 | 6/2013 | Goebel et al. |
| 2013/0205778 | A1 | 8/2013 | Hansen |
| 2013/0216445 | A1 | 8/2013 | Hartvigsen et al. |
| 2014/0008033 | A1 | 1/2014 | Howes et al. |
| 2014/0060051 | A1 | 3/2014 | Ohler et al. |
| 2014/0110080 | A1 | 4/2014 | Bergan |
| 2014/0245756 | A1 | 9/2014 | Morgan et al. |
| 2015/0059342 | A1 | 3/2015 | Kruger et al. |
| 2015/0260463 | A1 | 9/2015 | Laughlin et al. |
| 2015/0300719 | A1 | 10/2015 | Strickland et al. |
| 2016/0298498 | A1* | 10/2016 | Kreuger ..... F03G 6/068 |
| 2020/0131989 | A1* | 4/2020 | Toshima ..... F28D 20/0034 |

FOREIGN PATENT DOCUMENTS

| | | | | |
|---|---|---|---|---|
| DE | 102017000826 | A1 * | 3/2018 | ..... F01K 13/00 |
| EP | 2778406 | A1 | 9/2014 | |
| GB | 423093 | | 4/1933 | |
| WO | 2014052927 | A1 | 4/2014 | |

OTHER PUBLICATIONS

T. Steinparzer et al.; 2012 "Heat exchangers and thermal energy storage concepts for the off-gas heat of steelmaking devices"; J. Phys.: Conf. Ser., vol. 395 012158.

Mehalic, B.; "Solar Hot Water Storage"; Home Power magazine; Jun./Jul. 2009; 5 pgs.; downloaded from homepower.com.

"How Thermal Energy Storage Works"; published on or around Aug. 31, 2018, by Calmac, Fair Lawn, NJ.

U.S. Appl. No. 18/337,561; filed Jun. 20, 2023; USPTO, Alexandria, VA.

* cited by examiner

ENERGY STORAGE AND RETRIEVAL SYSTEMS AND METHODS

FIELD OF THE INVENTION

The present invention generally relates to the field of energy storage and retrieval. More specifically, embodiments of the present invention pertain to methods and systems for thermal energy storage and retrieval using an improved trilateral cycle and/or heat recovery during discharge/energy retrieval.

DISCUSSION OF THE BACKGROUND

The demand for inexpensive energy storage and retrieval is great now. The cost of fossil fuels and hydrocarbon gasses is high, and their availability is low, particularly in Europe. This is having extraordinary effects on the price and availability of electricity, particularly in times of high demand.

Carbon dioxide is a readily-available, inexpensive material. There is a great demand to find new uses for carbon dioxide, at least in part to remove it from the Earth's atmosphere.

When the high-temperature storage tank in a thermal energy storage systems empties, the pressure in the tank drops, and some of the thermal energy storage medium (which is generally in the liquid phase) evaporates. The heat of vaporization taken from the thermal energy storage medium when it evaporates can be significant, and the lost heat of vaporization lowers the system's capacity.

This "Discussion of the Background" section is provided for background information only. The statements in this "Discussion of the Background" are not an admission that the subject matter disclosed in this "Discussion of the Background" section constitutes prior art to the present disclosure, and no part of this "Discussion of the Background" section may be used as an admission that any part of this application, including this "Discussion of the Background" section, constitutes prior art to the present disclosure.

SUMMARY OF THE INVENTION

Embodiments of the present invention relate to methods and systems for thermal energy storage and retrieval. In one aspect, the invention relates to an energy storage and retrieval system, comprising a thermal energy storage subsystem and a new, improved thermodynamic cycle. The thermal energy storage subsystem comprises a high-temperature energy storage tank storing an energy storage medium at a first temperature, one or more first pressure changing devices configured to transport the energy storage medium between the high-temperature energy storage tank and a source of the energy storage medium, and a first heat exchanger through which the energy storage medium passes. The first heat exchanger is configured to exchange heat between the first energy storage medium and a working fluid (in the thermodynamic cycle) over a first temperature range. The thermodynamic cycle contains the working fluid, has a high-pressure side and a low-pressure side, and comprises a compressor/expander configured to change a pressure of the working fluid between the high-pressure and low-pressure sides of the thermodynamic cycle, a second heat exchanger, a substantially isothermal heat exchanger through which the working fluid passes, and one or more second pressure changing devices configured to transport the working fluid from the substantially isothermal heat exchanger to the second heat exchanger when the energy storage and retrieval system is discharging and from the second heat exchanger to the substantially isothermal heat exchanger when the energy storage and retrieval system is charging. The substantially isothermal heat exchanger is configured to exchange heat at a substantially constant temperature between the working fluid and the energy storage medium or an external environment, and is in fluid communication with the second heat exchanger. The first heat exchanger may comprise a high-temperature gradient heat exchanger. The second heat exchanger is configured to (i) transfer excess heat from the high-pressure side of the thermodynamic cycle to the low-pressure side of the thermodynamic cycle and thus preheat the working fluid to be compressed by the compressor/expander when charging, and (ii) transfer heat from the working fluid expanded by the compressor/expander in the low-pressure side of the thermodynamic cycle to the high-pressure side of the thermodynamic cycle when discharging. The thermodynamic cycle may comprise a trilateral cycle (e.g., a modified trilateral cycle with an internal superheat transfer).

In some embodiments, the source of the energy storage medium comprises a low-temperature energy storage tank storing the energy storage medium at a second temperature less than the first temperature and greater than the substantially constant temperature. In other embodiments, the source of the energy storage medium is an external environment, such as an external atmosphere or a large body of water (e.g., a large, man-made storage tank or pool, a natural body of water such as a lake, river, bay, basin, sea, etc.).

In other or further embodiments, the high-temperature energy storage tank and the low-temperature energy storage tank have a pressurized gas therein, and the energy storage and retrieval system further comprises a first conduit (e.g., one or more pipes or tubes) fluidly connecting the pressurized gas in the low-temperature energy storage tank and the pressurized gas in the high-temperature energy storage tank. Typically, the first conduit is configured to balance (e.g., partially or fully equalize) a first pressure in the high-temperature energy storage tank with a second pressure in the first low-temperature energy storage tank. In one example, the first conduit may pass through at least the first heat exchanger, and the pressurized gas in the first conduit exchanges heat with the energy storage medium and/or the working fluid in the first heat exchanger.

In various embodiments, the second heat exchanger may comprise one or more low-temperature gradient heat exchangers configured to exchange heat over a second temperature range lower than the first temperature range. In one example, the second heat exchanger comprises a low-temperature gradient heat exchanger configured to exchange heat between the first energy storage medium and the working fluid in both the high-pressure and low-pressure sides of the thermodynamic cycle over the second temperature range. In another example, the second heat exchanger comprises a first low-temperature gradient heat exchanger configured to exchange heat between the first energy storage medium and the working fluid in the high-pressure side of the thermodynamic cycle, and a second low-temperature gradient heat exchanger configured to exchange heat between the high-pressure and low-pressure sides of the thermodynamic cycle.

In some embodiments, the energy storage medium comprises water. In other or further embodiments, the working fluid comprises carbon dioxide, although the invention is not limited to either water as the energy storage medium or carbon dioxide as the working fluid.

In some embodiments, the first pressure changing device(s) may comprise a reversible propeller pump. In other embodiments, the first pressure changing devices may comprise a conventional one-way pump (e.g., a circulation pump) configured to move the energy storage medium from the source of the energy storage medium to the high-temperature energy storage tank when the energy storage and retrieval system is charging, and a turbine in parallel with the one-way pump, configured to convert a flow of the energy storage medium to another form of energy (e.g., electricity, rotary mechanical energy, etc.) when the energy storage and retrieval system is discharging. In such other embodiments, the first pressure changing devices may further comprise first and second three-way valves upstream and downstream from the one-way pump and the turbine, configured to control a direction of the flow of the energy storage medium when the system is charging and/or discharging, and optionally, a second one-way pump configured to move the energy storage medium from the high-temperature energy storage tank to the turbine, or from the turbine to the source of the energy storage medium, when the energy storage and retrieval system is discharging. The second one-way pump may be advantageous when the system includes the conduit connecting the low- and high-temperature energy storage tanks. Alternatively, the first pressure changing devices may comprise first and second one-way pumps, configured to move the energy storage medium in a first direction (e.g., from the high-temperature energy storage tank to the source of the energy storage medium) when the energy storage and retrieval system is charging, and in a second direction opposite from the first direction when the energy storage and retrieval system is discharging.

In other or further embodiments, the second pressure changing device(s) may comprise a first pump configured to transport the working fluid from the substantially isothermal heat exchanger to the gradient heat exchanger when the energy storage and retrieval system is discharging, and a second one-way pump, configured to transport the working fluid from the gradient heat exchanger to the substantially isothermal heat exchanger when the energy storage and retrieval system is charging. Alternatively, in place of the second one-way pump, the second pressure changing devices may comprise a turbine between the gradient heat exchanger and the substantially isothermal heat exchanger, driven by the working fluid when the energy storage and retrieval system is charging.

In one particular application, the present invention concerns a submarine, comprising the present thermal energy storage and retrieval system, and a hull enclosing at least the high-temperature energy storage tank, the first and second heat exchangers, the first and second pressure changing device(s), and the compressor/expander. The hull may further enclose a low-temperature energy storage tank, and in some embodiments, the substantially isothermal heat exchanger may be in the hull or in thermal contact with the hull. The submarine may use the thermal energy stored in the high-temperature energy storage tank for air-independent propulsion (AIP) or air-independent power, and may be nuclear or non-nuclear.

In another aspect, the invention relates to a thermal energy storage and retrieval system, comprising a low-temperature energy storage tank storing a thermal energy storage medium at a first temperature and having a pressurized gas therein, a high-temperature thermal energy storage tank storing the thermal energy storage medium at a second temperature higher than the first temperature and having the pressurized gas therein, one or more first pressure changing devices configured to transport the thermal energy storage medium between the low-temperature thermal energy storage tank and the high-temperature thermal energy storage tank, a first heat exchanger through which the thermal energy storage medium passes, a first conduit (i) fluidly connecting the pressurized gas in the low-temperature thermal energy storage tank and the pressurized gas in the high-temperature thermal energy storage tank and (ii) passing through the first heat exchanger, and a thermodynamic cycle. The first heat exchanger is configured to exchange heat between the thermal energy storage medium and a working fluid in the thermodynamic cycle. The pressurized gas in the first conduit exchanges heat with the thermal energy storage medium and/or the working fluid in the first heat exchanger. The thermodynamic cycle comprises a second heat exchanger configured to exchange heat between the working fluid and an external environment or a heat source/sink, a compressor/expander in fluid communication with the heat exchanger and (directly or indirectly) the second heat exchanger, and one or more second pressure changing devices between and in fluid communication with the first heat exchanger and the second heat exchanger. The compressor/expander is configured to change a pressure of the working fluid between the first heat exchanger and the second heat exchanger. The second pressure changing device(s) are configured to transport the working fluid from the second heat exchanger to the first heat exchanger when the thermal energy storage and retrieval system is discharging, and from the first heat exchanger to the second heat exchanger when the thermal energy storage and retrieval system is charging. In various embodiments, the thermodynamic cycle comprises a Brayton cycle or a trilateral cycle, either of which may be further combined with a Rankine cycle, a Stirling cycle, or the other of the Brayton cycle or the trilateral cycle.

In some advantageous embodiments, the thermal energy storage medium may comprise water, and/or the second heat exchanger may comprise a substantially isothermal heat exchanger, as described above/herein. In further embodiments, the thermal energy storage and retrieval system further comprises one or more first valves configured to open and close the first conduit, one or more vents or second valves on each of the low-temperature thermal energy storage tank and the high-temperature thermal energy storage tank, the vent(s) or second valve(s) may be configured to reduce a pressure of the pressurized gas in the respective low-temperature thermal energy storage tank or high-temperature thermal energy storage tank.

In the thermal energy storage and retrieval system including the first conduit, when the thermal energy storage and retrieval system is discharging, the pressurized gas in the first conduit may recover a first amount of heat from the thermal energy storage medium and/or the working fluid, the thermal energy storage medium may lose a second amount of heat due to evaporation in the high-temperature thermal energy storage tank (e.g., in the absence of the first conduit), and the first amount of heat offsets at least some of the second amount of heat. Additionally or alternatively, the high-temperature thermal energy storage tank may at times be in a partially-charged, partially-discharged state for a length of time sufficient for vaporization of the thermal energy storage medium therein to be appreciable in an otherwise identical system in which the high-temperature thermal energy storage tank is closed or sealed. For example, the length of time may be a minimum of four (4) hours, eight (8) hours, or another value during which the pressurized gas in the first conduit recovers a sufficient amount of heat from the thermal energy storage medium and/or the working fluid to offset at least half of the heat that would have been lost to evaporation of the thermal energy storage medium in the high-temperature thermal energy storage tank.

Yet another aspect of the invention relates to a method of recovering heat when discharging a thermal energy storage medium stored in a high-temperature thermal energy storage tank, comprising pressurizing a gas in each of the high-temperature thermal energy storage tank and a low-temperature thermal energy storage tank in fluid communication with the high-temperature thermal energy storage tank, discharging the thermal energy storage medium from the high-temperature thermal energy storage tank to the low-temperature thermal energy storage tank, passing the thermal energy storage medium through one or more heat exchangers between and in fluid communication with the high-temperature thermal energy storage tank and the low-temperature thermal energy storage tank when discharging the thermal energy storage medium, and passing the pressurized gas through a first conduit fluidly connecting the low-temperature thermal energy storage tank and the high-temperature thermal energy storage tank, and in or passing through at least one of the heat exchanger(s). The high-temperature thermal energy storage tank stores the thermal energy storage medium at a first temperature, and the low-temperature thermal energy storage tank storing the thermal energy storage medium at a second temperature lower than the first temperature. The pressurized gas in the first conduit exchanges heat with the thermal energy storage medium, thereby recovering at least some of the heat when the thermal energy storage medium is discharged.

In some embodiments, discharging the thermal energy storage medium comprises pumping the thermal energy storage medium from the high-temperature thermal energy storage tank to the low-temperature thermal energy storage tank. Alternatively, discharging the thermal energy storage medium may comprise driving a turbine with a flow of the thermal energy storage medium. Further embodiments of the method may comprise rejecting heat from the thermal energy storage medium to a working fluid in the thermodynamic cycle (e.g., the trilateral cycle or the Brayton cycle) in the heat exchanger(s) when discharging the thermal energy storage medium.

The present system and method can use carbon dioxide as a working fluid and water as a storage medium. Both water and carbon dioxide are inexpensive and plentiful, and water is environmentally friendly. Water is an advantageous heat storage medium due to its relatively large heat capacity (e.g., in comparison with other materials that are in a liquid phase at ambient temperatures).

The tanks for the storage medium may be relatively simple and inexpensive, because the heat storage medium may be stored and used at a relatively low temperature and at moderate pressure. The system may include as few as two storage tanks, yet remain independent of the environment, or as few as one storage tank, while also using the external environment as a heat source/sink.

Other advantages of the present invention will become readily apparent from the detailed description of various embodiments below.

DETAILED DESCRIPTION

Figure 1:
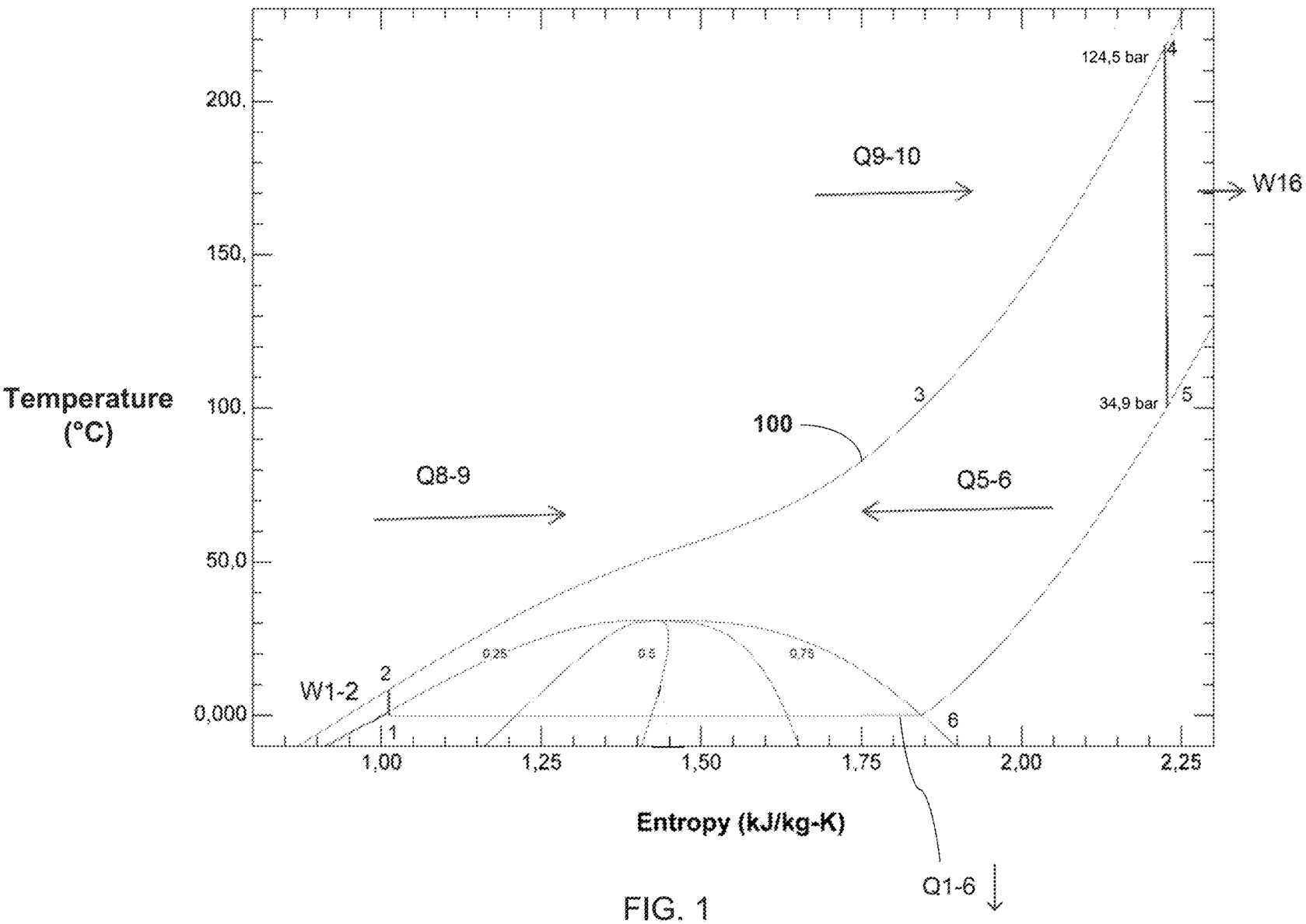
FIG. 1 is a temperature-entropy (TS) diagram showing a modified trilateral cycle for carbon dioxide ($CO_2$), in accordance with an embodiment of the present invention.

Reference will now be made in detail to one or more embodiments of the invention, examples of which are illustrated in the accompanying drawings. While the invention will be described in conjunction with the following embodiments, it will be understood that the descriptions are not intended to limit the invention to these embodiments. On the contrary, the invention is intended to cover alternatives, modifications and equivalents that may be included within the spirit and scope of the invention. Furthermore, in the following detailed description, numerous specific details are set forth in order to provide a thorough understanding of the present invention. However, it will be readily apparent to one skilled in the art that the present invention may be practiced without these specific details. In other instances, well-known methods, procedures and components have not been described in detail so as not to unnecessarily obscure aspects of the present invention. Furthermore, it should be understood that the possible permutations and combinations described herein are not meant to limit the invention. Specifically, variations that are not inconsistent may be mixed and matched as desired.

The technical proposal(s) of embodiments of the present invention will be fully and clearly described in conjunction with the drawings in the following embodiments. It will be understood that the descriptions are not intended to limit the invention to these embodiments. Based on the described embodiments of the present invention, other embodiments can be obtained by one skilled in the art without creative contribution and are in the scope of legal protection given to the present invention.

Furthermore, all characteristics, measures or processes disclosed in this document, except characteristics and/or processes that are mutually exclusive, can be combined in any manner and in any combination possible. Any characteristic disclosed in the present specification, claims, Abstract and Figures can be replaced by other equivalent characteristics or characteristics with similar objectives, purposes and/or functions, unless specified otherwise.

For the sake of convenience and simplicity, "part," "portion," and "region" may be used interchangeably herein, but are generally given their art-recognized meanings. Wherever one such term is used, it also encompasses the other terms. Also, unless indicated otherwise from the context of its use herein, the terms "known," "fixed," "given," "certain" and "predetermined" generally refer to a value, quantity, parameter, constraint, condition, state, process, procedure, method, practice, or combination thereof that is, in theory, variable, but is typically set in advance and not varied thereafter when in use.

The term "ambient temperature," which may also be known as room temperature, refers to a temperature typically in the range of 15-30° C. (e.g., 18-25° C., or any temperature or range of temperatures therein).

An Exemplary Energy Storage and Retrieval System

Figure 2:
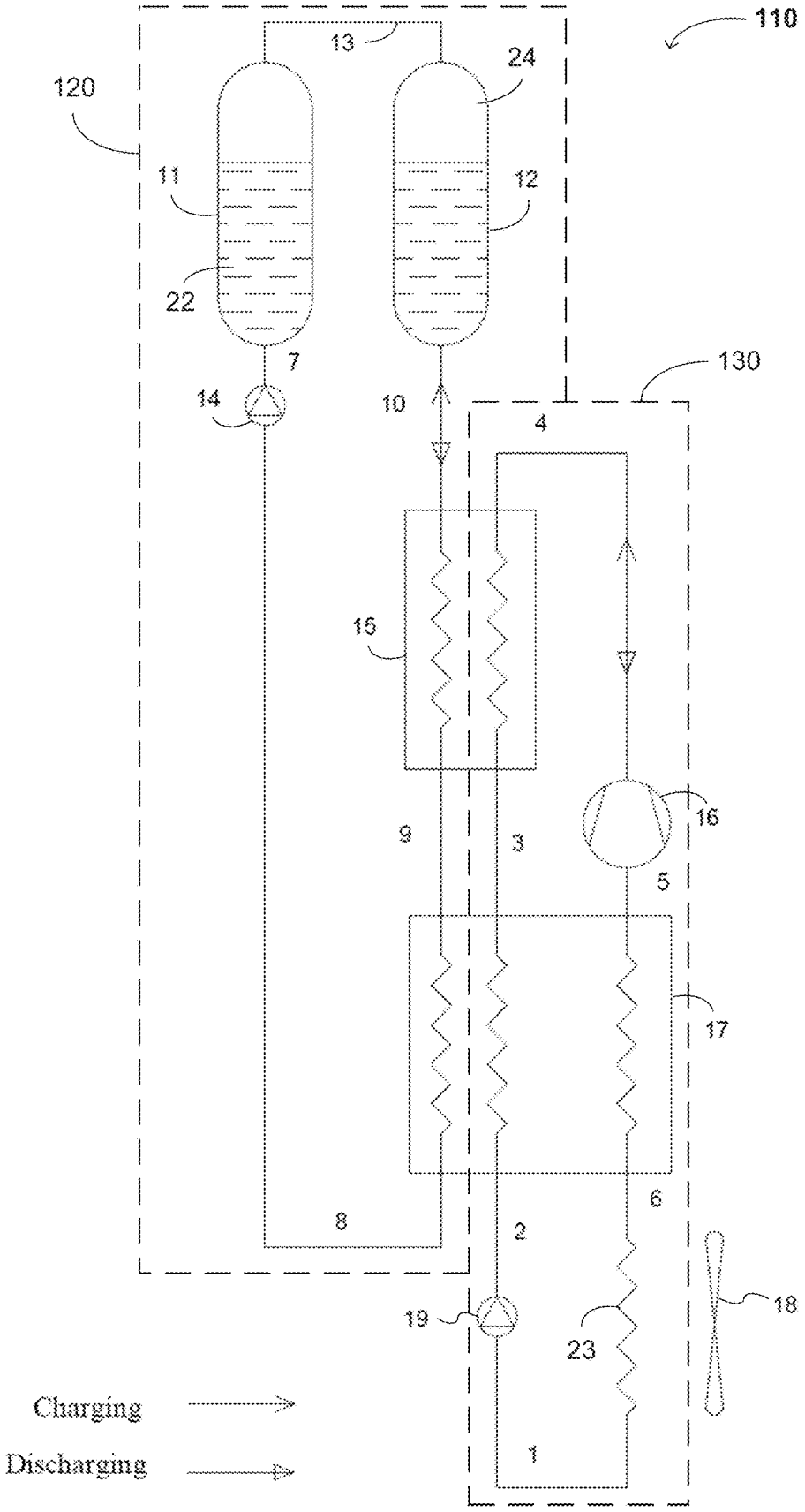
FIG. 2 is a schematic diagram of an exemplary system in accordance with the present invention, including a trilateral expansion-heat exchange-compression-heat exchange cycle and a thermal energy storage subsystem including pressure-equalized low-temperature and high-temperature storage tanks.

FIG. 1 shows a temperature vs. entropy plot for a trilateral cycle 100 that uses carbon dioxide as a working fluid and includes an internal superheat transfer $Q_{5-6}$. The trilateral cycle 100 is useful for thermoelectric energy storage in a liquid such as water. In the trilateral cycle of FIG. 1, 1-2 represents a process that increases the temperature of the working fluid slightly without changing the entropy, 2-3 and 3-4 represent isobaric, increasing-temperature gradient heat transfer processes, 4-5 represents an adiabatic expansion process, 5-6 represents an isobaric, decreasing-temperature gradient heat transfer process, and 6-1 represents an isothermal heat transfer process (i.e., heat transfer to another medium; e.g., as a result of a phase change of the working fluid in the cycle from gas to liquid at 0° C.). The heat added to the cycle from a heat source is $Q_{in}=Q_{8-9}+Q_{9-10}$. The heat delivered from the cycle (e.g., to a heat sink) is $Q_{out}=Q_{5-6}+Q_{6-1}$. The mechanical power added to the cycle is $W_{in}=W_{1-2}$. The mechanical power produced by and/or transferred within the system is $W_{out}=W_{16}$.

The trilateral cycle 100 is reversible. Consequently, the diagram of FIG. 1 also shows a trilateral heat pump cycle with a heat source at a constant temperature of 0° C. and a gradient heat sink when operating in the opposite direction (counter-clockwise) as a heat pump. In the reverse cycle, 6-5 represents an isobaric, increasing-temperature gradient heat transfer process, 5-4 represents an adiabatic compression, 4-3-2 represents an isobaric, decreasing-temperature gradient heat transfer process, 2-1 represents a pressure recovery process, and 1-6 represents an isothermal and isobaric heat transfer (e.g., phase change from liquid to gas). The heat added to the cycle from a heat source is $Q_{in}=Q_{1-6}+Q_{6-5}$. The heat delivered from the cycle to a heat sink is $Q_{out}=Q_{4-3}+Q_{3-2}$. The mechanical power added to the cycle is $W_{in}=W_{5-4}$ (i.e., $-W_{16}$). The mechanical power delivered from the cycle is $W_{out}=W_{2-1}$ (i.e., $-W_{1-2}$).

The trilateral cycle 100 takes advantage of the specific heat of carbon dioxide being different in different temperature ranges. For example, at a relatively high given pressure (e.g., 124.5 bar, as shown in FIG. 1), the specific heat of carbon dioxide from 7° C. to 100° C. is 274 kJ/kg, about 83% higher than at temperatures between 100-208° C. (150 kJ/kg). Also, the higher the pressure of the working fluid, the more linear the gradient curve becomes (e.g., between 2 and 4 in FIG. 1), and the more constant the specific heat of the working fluid.

In addition, the expansion ratio in the cycle 100 when the working fluid is carbon dioxide is 1:2.6, whereas with other working fluids such as dimethyl ether (DME) or pentane, the expansion ratio is much higher (e.g., >1:10, and in the case of DME, as high as 1:36). The expansion ratio is the ratio of the pressure in the low-pressure heat transfer process 5-6 to the pressure in the high-pressure heat transfer processes 2-3-4. Thus, the expansion process 4-5 and the compression process 5-4 can be done in a single step (e.g., with a single-stage reversible expander/compressor).

In part, the present invention concerns a method and system for thermal energy storage and retrieval. FIG. 2 shows an exemplary system 110. The system includes a thermal energy storage subsystem 120 and a modified trilateral heat engine/heat pump 130. The thermal energy storage subsystem 120 comprises a low-temperature energy storage tank 11, a high-temperature energy storage tank 12, a pipe or other conduit 13 connecting the uppermost spaces in the low-temperature energy storage tank 11 and the high-temperature energy storage tank 12, and a two-way pump 14 that transfers a thermal energy (heat) storage medium 22 between the low-temperature energy storage tank 11 and the high-temperature energy storage tank 12. The thermal energy storage medium 22 may be (or comprise) water. The high-temperature energy storage tank 12 may store the heat storage medium 22 at a relatively high temperature (e.g., 100-300° C., or any temperature or range of temperatures therein, such as 200-250° C.). The heat storage medium 22 may be stored in the low-temperature energy storage tank 11 at a relatively low temperature (e.g., 0-50° C., or any temperature or range of temperatures therein).

In general, the conduit 13 equalizes the pressure of the gas(es) in the low-temperature energy storage tank 11 and the high-temperature energy storage tank 12. For example, the pressure gas pressure in energy storage tanks 11 and 12 may be 2-40 bar, or any pressure or range of pressures therein (such as 15-20 bar), but the invention is not limited to this range. Furthermore, in various embodiments, there may be a valve (not shown) in each of the energy storage tanks 11 and 12 configured to vent or relieve excess gas pressure in the tank and/or open the tank to atmospheric pressure, as well as a valve in the conduit 13 configured to open and close the conduit 13. For example, when the pressure in the energy storage tanks 11 and 12 is >1 atm, one may close the valve in the conduit 13 and open the valve in one of the energy storage tanks 11 and 12 to use the excess pressure in the other energy storage tank to help drive the flow of the thermal energy storage medium 22 from the energy storage tank retaining the excess pressure to the energy storage tank from which the excess pressure was relieved, thereby reducing stress and wear on the pump 14.

The trilateral heat engine/heat pump 130 implements the trilateral cycle 100 shown in FIG. 1. The identification numbers 1-6 in FIG. 2 correspond to points 1-6 in the trilateral cycle 100 of FIG. 1. The pressure recovery-isothermal heat exchange-gradient heat exchange-compression-gradient heat exchange cycle 2-1-6-5-4-3-2 (charging) and reverse cycle 2-3-4-5-6-1-2 (discharging) may use carbon dioxide as the working fluid, although other fluids having similar thermal properties (e.g., specific heat, coefficient of thermal expansion, [latent]heats of condensation and/or evaporation, etc.) may also be suitable. For example, ethylene glycol may be added to the energy storage medium, in which case the temperature range may be extended below 0° C.

Referring to FIG. 2, the trilateral cycle 130 comprises first and second gradient heat exchangers 17 and 15, a reversible expander/compressor 16, an isothermal heat exchanger 23 that may be further equipped with a circulating device 18, and a reversible pump 19. The circulating device 18 may comprise a fan, a mixer (e.g., with two or more blade configured radially around a rotating axle), a pump, etc. The reversible pump 19 may comprise a gear pump, a screw-pump (e.g., a three-screw, positive displacement rotary pump sold under the IMO trademark, commercially available from CIRCOR International, Inc., Monroe, NC), or similar reversible device. The heat exchangers 15 and 17 exchange heat between the working fluid in the trilateral cycle 130 and the thermal energy storage medium 22. The heat exchanger 17 also exchanges heat internally between different segments of the trilateral cycle 130 (i.e., the working fluid in the gradient heat exchange 2-3 or 3-2 and the working fluid in the gradient heat exchange 5-6 or 6-5, respectively). As a result of the heat exchange between different segments of the trilateral cycle 130, the nodes 3 and 5 in the trilateral cycle 130 (points 3 and 5 in the trilateral cycle 100 of FIG. 1) are at the same temperature. In the case of FIG. 1, the temperature at points 3 and 5 is 100° C., but with different working fluids, or at different pressures with the same working fluid, this temperature may be different.

Referring back to FIG. 2, when the system 110 is charging, the thermal energy storage medium 22 in the thermal energy storage subsystem 120 is pumped by the two-way pump 14 from the low-temperature energy storage tank 11, through the heat exchangers 17 and 15, to the high-temperature energy storage tank 12. In the trilateral cycle 130, and the working fluid passes through the heat exchangers 15 and 17 (i.e., in the reverse direction from the thermal energy storage medium 22) at 4-3-2, where it rejects heat to the thermal energy storage medium 22. The working fluid is at a relatively high pressure and is in a supercritical phase in the heat exchangers 15 and 17. The working fluid then may be pumped through the isothermal heat exchanger 23 and the heat exchanger 17 at 1-6-5 by the pump 19. In the pump 19 (or equivalent device, as described herein), the working fluid changes phase, from supercritical to liquid. The isothermal heat exchanger 23 has a temperature at which the working fluid changes phase again, from liquid to gas. In the heat exchanger 17, the working fluid passing through the heat exchanger 17 at 6-5 (i.e., the low-pressure segment of the cycle 130) absorbs heat from the working fluid at 3-2 (i.e., in the high-pressure segment of the cycle 130). At 5-4, the working fluid is compressed by the compressor/expander 16 from the relatively low pressure (e.g., 34.9 bar, as shown in FIG. 1) to the relatively high pressure (e.g., 124.5 bar). The working fluid is also heated by the compression, from a relatively low temperature (e.g., 100° C., as shown in FIG. 1) to a relatively high temperature (e.g., 208° C.).

In some embodiments, a turbine or throttle valve (not shown) can be configured in parallel with the pump 19, in which first and second three-way valves (also not shown) direct the flow of the working fluid through either the pump 19 or the turbine/throttle valve in the trilateral cycle 130. The turbine may drive the generation of electricity or other form of usable energy (e.g., mechanical energy), and the throttle valve may regulate and/or maintain the pressure of the working fluid in the low-pressure side of the cycle 130 so that the inlet conditions for the expansion are constant. It does this by introducing a flow restriction, inducing a significant localized pressure drop in the fluid.

When the system is discharging, the two-way pump 14 moves the thermal energy storage medium 22 from the high-temperature energy storage tank 12, through the heat exchangers 15 and 17, to the low-temperature energy storage tank 11, and the working fluid is pumped by the pump 19 through the heat exchangers 17 and 15, where the thermal energy storage medium 22 rejects stored heat to the working fluid (which in the case of carbon dioxide, is in a supercritical phase at 2-3-4 in the cycle 130). The working fluid then drives a mechanical energy recovery process (e.g., by expansion) in the expander/compressor 16, where it transitions from supercritical to gas phase, then rejects remaining heat in the heat exchanger 17 (at 5-6) to the working fluid in the high-pressure segment of the cycle 130 (i.e., at 2-3). The working fluid then passes through the isothermal heat exchanger 23, where it undergoes a phase change (e.g., from gas to liquid), thereby rejecting additional heat. In some embodiments, the medium to which the working fluid rejects heat in the isothermal heat exchanger 23 is an external environment (e.g., the external atmosphere; a large body of water, such as a lake, sea, bay, basin, river, etc.). When the medium in the isothermal heat exchanger 23 is the external atmosphere (e.g., the air outside or above a building), the energy storage medium 22 may pass through a pipe or tube (which may, for example, be thermally connected to a plurality of cooling fins) in the outside/outdoor air. The circulating device 18 may help circulate the isothermal medium to help maintain its constant temperature.

When the working fluid is carbon dioxide, its high density at 0° C. means that the isothermal heat exchanger 23 can be relatively compact, with a relatively small surface area. Furthermore, when maintained at a temperature of 0° C., the medium to which the working fluid rejects heat in the isothermal heat exchanger 23 may be a relatively large tank of water containing both liquid water and ice. The ice may be maintained by periodic additions of ice to the isothermal exchange medium (and, optionally, withdrawals of liquid water from the isothermal exchange medium), or by external cooling of the tank (e.g., using a conventional refrigeration system or Peltier cooler).

However, the working fluid is not limited to carbon dioxide, nor is the temperature of the medium in the isothermal heat exchanger 23 limited to 0° C. One of the advantages of the present modified trilateral cycle is that the superheat at 5-6/6-5 (FIG. 1) results in a small compression/expansion ratio, which in turn results in a relatively high pressure at 6-1/1-6 (e.g., in the isothermal heat exchanger 23; see FIGS. 2-3). As a result, the isothermal heat exchanger 23 can benefit from a relatively compact design. In addition, when discharging, the working fluid (or working medium) in the gradient heat exchangers 15 and 17 receives heat from the thermal energy storage medium 22 over the entire temperature range 100-208° C. (FIG. 1), plus additional heat from the superheat in the low-pressure segment of the cycle 130 in the temperature range 0-100° C.

Furthermore, when the high-temperature storage tank 12 in FIG. 2 empties, the pressure in the high-temperature storage tank 12 drops, and some of the thermal energy storage medium 22 (which is generally in the liquid phase) evaporates. The heat of vaporization taken from the thermal energy storage medium 22 when it evaporates can be significant, and the lost heat of vaporization lowers the system's capacity.

To increase the useful heat capacity in the system 110, the low-temperature thermal energy storage tank 11 and the high-temperature thermal energy storage tank 12 may be pressurized with a gas 24 therein. The upper parts of the low- and high-temperature thermal energy storage tanks 11 and 12 are connected with a pipe 13. When the pressure decreases in the high-temperature thermal energy storage tank 12 (e.g., when the thermal energy storage medium 22 is pumped or transferred from the high-temperature thermal energy storage tank 12), the pressurized gas 24 flows from the low-temperature thermal energy storage tank 11 to the high-temperature thermal energy storage tank 12. Thus, in its simplest form, the pressure in the low-temperature thermal energy storage tank 11 and the high-temperature thermal energy storage tank 12 is substantially the same. As a result, the power consumed by the pump 14 that pumps the thermal energy storage medium 22 between the low-temperature thermal energy storage tank 11 and the high-temperature thermal energy storage tank 12 is much less than without the pressurized gas 24. For example, the pump 14 may comprise a single reversible propeller pump or a reversible flow pump that needs only to overcome frictional losses in the conduits between the low-temperature thermal energy storage tank 11 and the high-temperature thermal energy storage tank 12. In a more specific embodiment, the reversible propeller pump includes a relatively precise variable speed control, to optimize its operation. Alternatively, the reversible pump 14 may comprise first and second parallel low-pressure, unidirectional circulation pumps, configured so that the direction of flow can be selected using first and second three-way valves, one upstream and one downstream of the parallel pumps. Such a dual-pump arrangement is disclosed in U.S. patent application Ser. No. 18/337,561, filed Jun. 20, 2023, the relevant portion(s) of which are incorporated herein by reference.

In various modifications, there may also be a pressure sensor (not shown) in the pipe 13 to monitor and/or measure the pressure of the gas 24, a valve through which additional pressurized gas can be added to (or excess pressurized gas can be removed from) the pipe 13 or the low-temperature thermal energy storage tank 11 (e.g., for safety reasons), and/or one or more pressure-activated valves (e.g., between one of the tanks 11 or 12 and the pipe 13) to control when the pressurized gas 24 is transferred from one of the tanks to the other (e.g., when the pressure differential on opposite sides of the valve exceeds a predetermined value, such as in the range of 1-10 atm). On the other hand, when the water flows from the low-temperature thermal energy storage tank 11 to the high-temperature thermal energy storage tank 12, the pressure decreases in the low-temperature thermal energy storage tank 11, and the pressurized gas 24 flows from the high-temperature thermal energy storage tank 12 to the low-temperature thermal energy storage tank 11 to balance the pressures in the tanks.

The pressurized gas 24 can be air when the high-temperature thermal energy storage tank 12 is galvanized or coated with a protective layer. When the high-temperature thermal energy storage tank 12 is made of steel, the pressurized gas 24 may be an inert gas, such as nitrogen or argon, to prevent corrosion of the steel.

An Exemplary Energy Storage and Retrieval System with Heat Recovery

Figure 3:
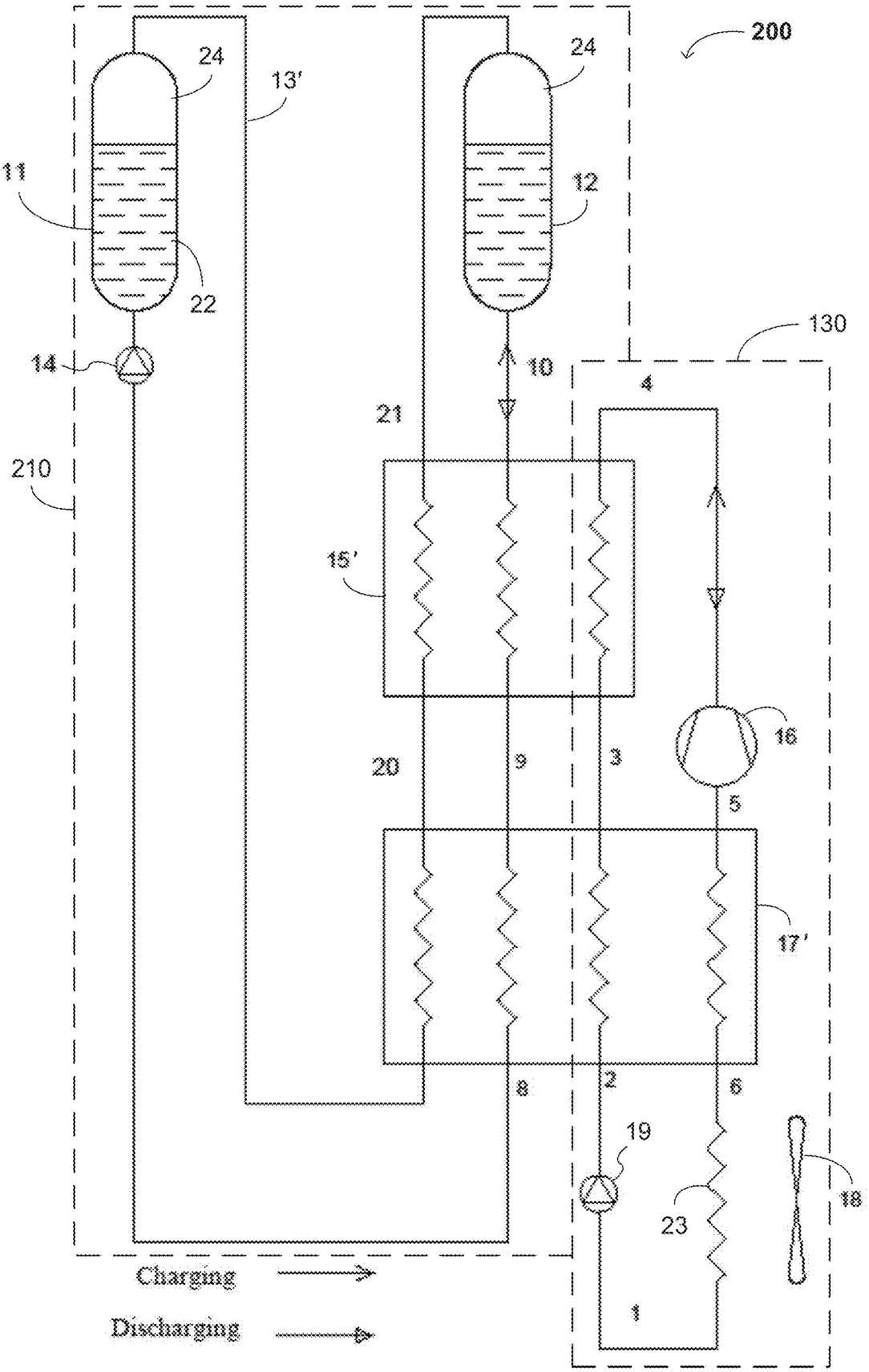
FIG. 3 is a schematic diagram of an exemplary system similar to that of FIG. 2, including a trilateral expansion-heat exchange-compression-heat exchange cycle and a thermal energy storage subsystem including pressure-equalized low-temperature and high-temperature storage tanks.

An advantageous embodiment is shown in FIG. 3, in which the pressurized gas 24 can be heated or cooled as the gas 24 flows between the low-temperature thermal energy storage tank 11 and the high-temperature thermal energy storage tank 12. The pressurized gas 24 can be heated or cooled with the working medium (i.e., the working fluid in the cycle 130) by passing the pressurized gas 24 through the heat exchangers 15' and 17'. Each of the heat exchangers 15' and 17' can comprise a gradient heat exchanger as disclosed in U.S. patent application Ser. No. 18/337,561, filed Jun. 20, 2023, the relevant portion(s) of which are incorporated herein by reference. However, in the thermal energy storage and retrieval system 200 shown in FIG. 3, the heat exchanger 17' is optional.

The exemplary system 200 in FIG. 3 comprises a low-temperature energy storage tank 11 storing a thermal energy storage medium 20 at a first temperature, a high-temperature thermal energy storage tank 12 storing the thermal energy storage medium at a second temperature higher than the first temperature, one or more first pressure changing devices (e.g., the reversible pump 14) configured to transport the thermal energy storage medium 20 between the low-temperature thermal energy storage tank 11 and the high-temperature thermal energy storage tank 12, a first heat exchanger 15' through which the thermal energy storage medium 20 passes, a first conduit 13', and a thermodynamic cycle or heat engine (e.g., trilateral cycle 130). The trilateral cycle 130 comprises a working fluid, a second heat exchanger 23 configured to exchange heat between the working fluid and an external environment or a heat source/sink, a compressor/expander 16 in fluid communication with the first heat exchanger 15' and (directly or indirectly) the second heat exchanger 23, and one or more second pressure changing devices (e.g., reversible pump 19) between and in fluid communication (directly or indirectly) with the first heat exchanger 15' and the second heat exchanger 23. The compressor/expander 16 is configured to change the pressure of the working fluid between the first heat exchanger 15' and the second heat exchanger 23. The pump 19 is configured to transport the working fluid from the second heat exchanger 23 to the first heat exchanger 15' (or a third heat exchanger 17' in series with the first heat exchanger 15') when the thermal energy storage and retrieval system 200 is discharging, and from the first heat exchanger 15' (or the third heat exchanger 17') to the second heat exchanger 23 when the thermal energy storage and retrieval system 200 is charging. The first heat exchanger 15' is configured to exchange heat between the thermal energy storage medium 20 and the working fluid in the trilateral cycle 130. The third heat exchanger 17' is optional in the system 200, and is configured to exchange heat among the thermal energy storage medium 20 and the working fluid in both the high-pressure side and the low-pressure side of the trilateral cycle 130.

The low-temperature energy storage tank 11 and the high-temperature thermal energy storage tank 12 have a pressurized gas 24 therein. The first conduit 13' fluidly connects the pressurized gas 24 in the low-temperature thermal energy storage tank 11 and the pressurized gas 24 in the high-temperature thermal energy storage tank 12, and also passes through the first heat exchanger 15' and the optional third heat exchanger 17'. In each of the first heat exchanger 15' and the third heat exchanger 17', the pressurized gas 24 in the first conduit 13' exchanges heat with the thermal energy storage medium 20 and the working fluid in the thermodynamic cycle 130. In some embodiments, the conduit 13' passes through only the first heat exchanger 15'. In such embodiments, when the thermodynamic cycle 130 includes the third heat exchanger 17' and the system 200 is charging, the pressurized gas 24 flows from the high-temperature thermal energy storage tank 12 to the low-temperature thermal energy storage tank 11, and enters the low-temperature thermal energy storage tank 11 at a temperature higher than the first temperature (i.e., the temperature of the thermal energy storage medium 20 in the low-temperature thermal energy storage tank 11). This may raise the first temperature very slightly, but when the low-temperature thermal energy storage tank 11 is sufficiently large, it may have substantially no effect on the first temperature.

In various embodiments, the thermodynamic cycle or heat engine in the system 200 may comprise a Brayton cycle, instead of the trilateral cycle 130. Either the Brayton cycle or the trilateral cycle may be further combined with a Rankine cycle, a Stirling cycle, or the other of the Brayton cycle and the trilateral cycle. As is known in the art, each of these thermodynamic cycles has at least one heat exchanger configured to exchange heat between the working fluid and an external environment or a heat source/sink, at least one heat exchanger that can be configured to exchange heat between the working fluid and a storage medium, a compressor/expander in fluid communication with the heat exchangers, and one or more pressure changing devices that change the pressure of the working fluid in a direction opposite from that of the compressor/expander. However, the Rankine and Stirling cycles have at least one substantially isothermal heat exchanger therein.

When the thermal energy storage and retrieval system 200 is discharging, the pressurized gas 24 in the conduit 13' may recover a first amount of heat from the thermal energy storage medium 22 and/or the working fluid. In some configurations of the first and third heat exchangers 15' and 17', the conduit 13' may be in thermal the thermal contact with one of the thermal energy storage medium 22 and the working fluid, but not (or not very much) with the other. The thermal energy storage medium 22 may lose a second amount of heat in the high-temperature thermal energy storage tank 12 due to evaporation, as the medium 22 is removed from the tank 12. In the absence of the first conduit, this second amount of heat may be appreciable. For example, the heat of vaporization of water at 208° C. and 1900 kPa (about 18.75 atm) is 1907.9 kJ/kg. In the system 200, the first amount of heat recovered by the pressurized gas 24 in the conduit 13' offsets at least some of the second amount of heat lost to vaporization of the thermal energy storage medium 22.

When the high-temperature thermal energy storage tank 12 is not full for a sufficiently long time, the pressurized gas 24 in the tank 12 becomes saturated with vapor of the thermal energy storage medium 22 (e.g., water). However, that heat (e.g., of vaporization) is not lost because it is returned by the pressurized gas 24 in the conduit 13' to the hot storage medium in the tank 12 via the heat exchanger 15' (and optionally the heat exchanger 17') during charging. On the other hand, if evaporation of the thermal energy storage medium 22 in the tank 12 is negligible, and discharge of the medium is sufficiently fast (e.g., there is a relatively short cycle time between discharging and charging processes), then including a heat exchanger in the gas connection (i.e., passing the conduit 13' through the heat exchangers 15' and 17') is not necessary, and the system 110 in FIG. 2 may be advantageous, as including a heat exchanger in the gas connection places some physical constraints on the design of the system 200.

Vaporization of liquid-phase materials is not necessarily an instantaneous process, however. Heat losses due to vaporization of a liquid-phase thermal energy storage medium 22 is more appreciable when the high-temperature thermal energy storage tank 12 in a partially-charged, partially-discharged state for a length of time sufficient for vaporization of the thermal energy storage medium 22 therein to be appreciable in an otherwise identical system in which the high-temperature thermal energy storage tank is closed or sealed (e.g., in which the conduit 13' is absent). Thus, in some embodiments, the pressurized gas 24 in the conduit 13' recovers a sufficient amount of heat from the thermal energy storage medium 22 and/or the working fluid to offset at least half of the heat that would have been lost to evaporation of the thermal energy storage medium 22 in the high-temperature thermal energy storage tank 22 in the absence of the conduit 13'. For example, the length of time may be a minimum of four (4) hours, eight (8) hours, or another value during which heat losses due to vaporization of the thermal energy storage medium 22 is sufficiently large to justify the recovery of the heat lost.

In various embodiments, the heat exchanger 23 exchanges heat between the working fluid and an external environment or a heat source/sink. In some embodiments, the working fluid exchanges heat in the heat exchanger 23 with an external environment, such as an external and/or ambient atmosphere, a large body of water, such as a lake, pond, river, sea, etc., or a thermally-stable underground heat reservoir. In some embodiments, the working fluid exchanges heat in the heat exchanger 23 with a heat source/sink, such as a man-made pool (e.g., containing water), a large block of concrete, a composite structure containing both thermally-conductive materials such as steel or aluminum and an insulator such as concrete, glass, brick and/or stone (e.g., a high-rise building or skyscraper), etc. As for the system 110 in FIG. 2, the heat exchanger 23 in FIG. 3 may further include a circulating device 18, as described herein.

In some advantageous embodiments, the thermal energy storage medium 22 may comprise water, and the heat exchanger 23 may comprise a substantially isothermal heat exchanger, as described herein. In further embodiments, the thermal energy storage and retrieval system 200 further comprises one or more valves (not shown) configured to open and close the conduit 13', and/or one or more vents or valves (not shown) on each of the low-temperature thermal energy storage tank 11 and the high-temperature thermal energy storage tank 12. The valves may be configured to add a gas (e.g., air, nitrogen, argon, etc.) to the respective storage tank 11 or 12, and the tank vents or valves may be configured to reduce a pressure of the pressurized gas 24 in the respective storage tank 11 or 12 (e.g., for safety purposes).

In embodiments in which the pressure difference between the high- and low-pressure sides of the thermodynamic cycle/heat engine 130 is sufficiently low (e.g., where the expansion ratio is <10:1), the second pressure changing device(s) may comprise the reversible pump 19. However, in embodiments in which the pressure difference between the high- and low-pressure sides of the thermodynamic cycle/heat engine 130 is sufficiently high (e.g., where the expansion ratio is >10:1), the second pressure changing device(s) may comprise a conventional one-way pump (e.g., a circulation pump) configured to move the working fluid from the heat exchanger 23 to the first or third heat exchanger 15' or 17' when the energy storage and retrieval system 200 is charging, and a turbine in parallel with the one-way pump, configured to convert a flow of the working fluid to another form of energy (e.g., electricity, rotary mechanical energy, etc.) when the energy storage and retrieval system 200 is discharging. In such embodiments, the thermodynamic cycle/heat engine 130 may further comprise first and second three-way valves upstream and downstream from the one-way pump and the turbine, configured to control a direction of the flow of the working fluid when the system is charging and/or discharging.

Alternatively, to prevent the energy storage medium 22 from evaporating and the resulting vapor from mixing with the pressurized gas 24 in the high-temperature thermal energy storage tank 12, the surface of the energy storage medium 22 can be covered with a floating body or a layer of a liquid that does not mix with the medium 22 and that has a lower density than the medium 22. For example, when the medium 22 comprises water, the floating body or layer of liquid may comprise silicone oil or, at the operating temperatures in the high-temperature thermal energy storage tank 12, paraffin wax.

An Exemplary Single-Tank Energy Storage and Retrieval System

Figure 4:
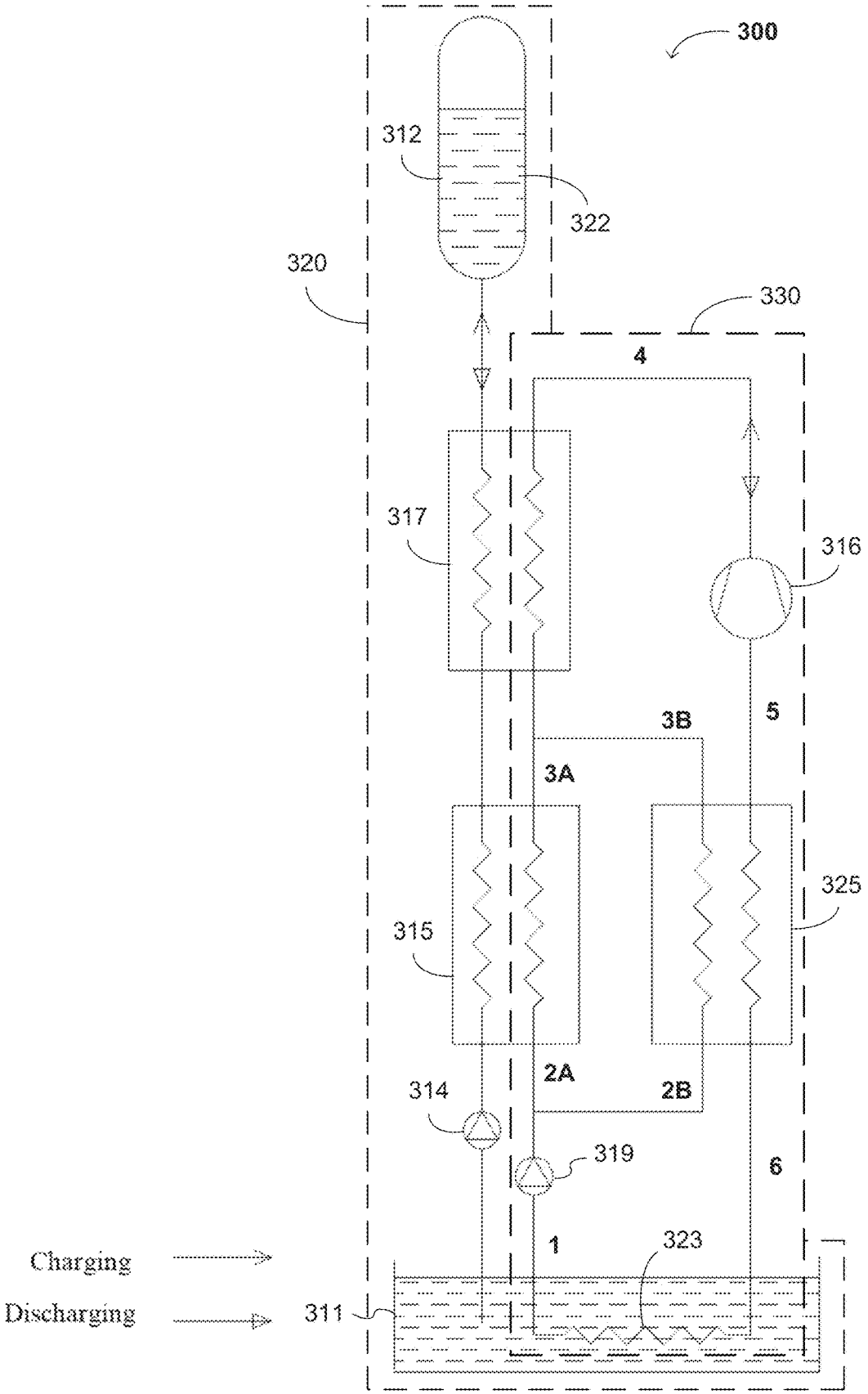
FIG. 4 shows an exemplary one-tank energy storage subsystem, working in conjunction with an exemplary trilateral cycle similar to that shown in FIG. 2.

FIG. 4 shows a one- or two-tank system 300, operating according to the principles of the systems of FIGS. 2 and 3. The system of FIG. 4 is similar to the system 110 of FIG. 2, except that the low-temperature thermal energy storage tank 311 can be a large-volume water storage tank, a man-made or natural body of water, such as a pond, a lake, a river, a sea or an ocean, or even an external atmosphere (see, e.g., FIGS. 2-3), and the gradient heat exchanger 15 the system 110 of FIG. 2 is split into a low-temperature gradient heat exchanger 315 and an internal (gradient) heat exchanger 325. Consequently, the pressure-balancing conduit 13 in FIG. 2 is absent from the system 300 in FIG. 4. The low-temperature thermal energy storage tank 311 should be at least several times (e.g., at least 3-5 times) the size of the high-temperature thermal energy storage tank 312, and the relative sizes may depend on the combined cost of the tanks 311 and 312. When the low-temperature thermal energy storage tank 311 is a body of water or an external atmosphere, the heat exchanger 323 in the trilateral cycle 330 does not need to be close to (e.g., in thermal contact with) a similar heat exchanger in the energy storage system 320.

In the system 300 of FIG. 4, the high-temperature thermal energy storage tank 311 is self-pressurizing during charging. Thus, during discharging, the energy storage medium 322 from the high-temperature thermal energy storage tank 312 can drive a first turbine (not shown). Conversely, during charging, the trilateral cycle 330 can drive a second turbine (not shown), configured in parallel with (but with an opposing flow from) the pump 319. When operating, each of the first and second turbines can drive the pump 319 or 314, respectively, in the other subsystem (i.e., the trilateral cycle 330 or the thermal energy storage subsystem 320). The configurations of the first and second turbines may further include first and second valves (not shown) to which conduits from each of the pump and the turbine in the respective subsystem connect, and which may be configured to direct the flow of the respective medium through either the pump or the turbine. Such valves may comprise conventional manual or electronically-controlled valves.

The thermal energy storage subsystem 320 in FIG. 4 comprises the high-temperature thermal energy storage tank 312, first and second gradient heat exchangers 315 and 317, a pump 85, and the low-temperature thermal energy storage tank 311. The trilateral cycle 330 in FIG. 4 comprises a two-way expander/compressor 316, an isothermal (or substantially isothermal) heat exchanger 323 in or passing through the low-temperature thermal energy storage tank 311, a pump 319, the first and second gradient heat exchangers 315 and 317, and a third gradient heat exchanger 325. The first and second gradient heat exchangers 315 and 317 exchange heat between the thermal energy storage material 322 in the thermal energy storage subsystem 320 and the working fluid in the high-pressure side of the trilateral cycle 330. The third gradient heat exchanger 325 exchanges heat between the working fluid in the high-pressure side of the trilateral cycle 330 and the working fluid in the low-pressure side of the trilateral cycle 330, and is thus a kind of "internal" heat exchanger.

The trilateral cycle 330 in FIG. 4 operates substantially identically to the trilateral cycle 130 in FIGS. 2 and 3, except that the proportion of the working fluid in the trilateral cycle 330 passing through the internal gradient heat exchanger 325 relative to the high-pressure gradient heat exchanger 315 is controlled, thereby enabling separation of the internal heat exchange process from those with the thermal energy storage medium 322 in the trilateral cycle 330. The design 300 including the internal gradient heat exchanger 325 and the low-temperature, high-pressure gradient heat exchanger 315 is an alternative to the design 110 including the low-temperature heat exchanger 17 of FIG. 2.

Determination and control of the proportion of the working fluid in the trilateral cycle 330 diverted to the internal gradient heat exchanger 325 from the first gradient heat exchanger 315 is within the level of skill in the art. For example, referring to the example of FIG. 1, in which the working fluid is carbon dioxide, the amount of heat $Q_{8-9}$ transferred in the first gradient heat exchanger 315 (at 2A-3A or 3A-2A) to/from the carbon dioxide is 156 kJ/kg, whereas the amount of heat $Q_{5-6}$ transferred in the internal gradient heat exchanger 325 (at 2B-3B or 3B-2B) to/from the high-pressure carbon dioxide is 121 kJ/kg. The amount of carbon dioxide passing through the first gradient heat exchanger 315 relative to the amount of carbon dioxide passing through the high-pressure side of the internal gradient heat exchanger 325 in the high-pressure side of the trilateral cycle 330 may be proportional to the amounts of heat transferred. Thus, in a relatively simple design, the conduits to/from the gradient heat exchangers 315 and 325 can be relatively simple T-joints or Y-joints, and the cross-sectional area of the conduit transporting the carbon dioxide to/from the first gradient heat exchanger 315 relative to that to/from the internal gradient heat exchanger 325 can be the ratio of the amounts of heat transferred (i.e., $Q_{8-9}$ to $Q_{5-6}$, or about 9:7 in this example). To maintain a constant pressure on the high-pressure side of the trilateral cycle 330, the conduits from high-temperature heat exchanger 317 and the pump 319 to the joints upstream/downstream of the heat exchangers 315 and 325 have a relative cross-sectional area equal to the sum of the numbers in the ratio of the cross-sectional areas of the conduits transporting the carbon dioxide to/from the first gradient heat exchanger 315 and the internal gradient heat exchanger 325 (in this example, 10).

In the high-temperature heat exchanger 317, the heat capacity of the working fluid is significantly lower (e.g., on average) than it is in the first (low-temperature) heat exchanger 315. For example, when the working fluid is carbon dioxide at a pressure of 124.5 bar, the heat capacity in the low-temperature heat exchanger 315 ranges from 2.19 to 1.80 kJ/kg-K (over a corresponding temperature range of 7-100° C.), but in the high-temperature heat exchanger 317, it ranges from 1.80 to 1.22 kJ/kg-K (over a corresponding temperature range of 100-208° C.). As a result, the amount of heat transferred to/by carbon dioxide in the low-temperature heat exchanger 315 (i.e., $Q_{8-9}$) is 274 kJ/kg, whereas in the high-temperature heat exchanger 317 (i.e., $Q_{9-10}$), it is 150 kJ/kg.

An Exemplar Application of the Present System(s)

One application of the present systems 110, 200 and 300 (FIGS. 2-4) is for air independent propulsion (AIP) for submarines. For example, certain non-nuclear submarines (e.g., certain Gotland-class, Södermanland-class, and Archer-class submarines manufactured and/or retrofit by Saab Kockums AB, Malmö, Sweden) in use in Sweden, Japan and Singapore include a Stirling engine for power generation while under water. The Stirling engine in such submarines can be replaced with the thermal energy storage and retrieval system 110, 200 or 300. For example, 300 m3 of water stored at a high temperature in a high-temperature thermal energy storage tank 12 or 312 can operate such a submarine underwater for 14 days with the same power output as the Stirling engine that it would replace. By omitting the low-temperature thermal energy storage tank 11, the system 300 of FIG. 4 would be somewhat smaller than the systems 110 and 200 of FIGS. 2-3, and could use sea water as the thermal energy storage medium (optionally, after filtering and/or purifying the sea water to eliminate particulates above a predetermined minimum size and/or to disinfect microbes such as bacteria, viruses, mold, fungi, etc.). The present thermal energy storage and retrieval system 110, 200 or 300 can also be used to store thermal energy generated by a nuclear power plant on a nuclear submarine.

Thus, the submarine may comprise the present thermal energy storage and retrieval system and a hull enclosing at least the high-temperature energy storage tank, the first and second heat exchangers, the first and second pressure changing device(s), and the compressor/expander. In some embodiments, the hull may further enclose a low-temperature energy storage tank. In other or further embodiments, the substantially isothermal heat exchanger may be in the hull or in thermal contact with the hull. The submarine may include other parts or components conventionally found in submarines, such as one or more propellers, one of more sources of stored air or oxygen, one or more fuel storage tanks, one or more propulsion mechanisms, one or more control systems, one or more communication systems, one or more living and/or sleeping quarters, etc.

An Exemplary Method of Recovering Heat Loss During Thermal Energy Retrieval

The invention concerns a method of recovering heat when discharging a thermal energy storage medium stored in a high-temperature thermal energy storage tank, such as the thermal energy storage medium 22 in the high-temperature thermal energy storage tank 12 (FIG. 3). For example, the method may comprise pressurizing a gas 24 in each of the high-temperature thermal energy storage tank 12 and the low-temperature thermal energy storage tank 11, discharging the thermal energy storage medium 22 from the high-temperature thermal energy storage tank 12 to the low-temperature thermal energy storage tank 11, passing the thermal energy storage medium 22 through one or more heat exchangers, such as the heat exchanger 15' and optionally the heat exchanger 17', when discharging the thermal energy storage medium 22, and passing the pressurized gas 24 through a conduit 13' fluidly connecting the low-temperature thermal energy storage tank 11 and the high-temperature thermal energy storage tank 12. The conduit 13' is in, or passes through, at least one of the heat exchangers 15' and 17'. The high-temperature thermal energy storage tank 12 stores the thermal energy storage medium 22 at a first temperature, and the low-temperature thermal energy storage tank 11 stores the thermal energy storage medium 22 at a second, lower temperature. The pressurized gas 24 in the conduit 13' exchanges heat with the thermal energy storage medium 22 and/or the working fluid in the thermodynamic cycle/heat engine 130, thereby recovering at least some of the heat when the thermal energy storage medium 22 is discharged.

The method is conducted in accordance with the operation of (e.g., heat recovery in) the thermal energy storage and retrieval system 220, as described herein. Thus, in some embodiments, discharging the thermal energy storage medium may comprise pumping the thermal energy storage medium 22 from the high-temperature thermal energy storage tank 12 to the low-temperature thermal energy storage tank 11 using a pump 14. Alternatively, discharging the thermal energy storage medium may comprise driving a turbine (not shown) with a flow of the thermal energy storage medium 22. The flow of the thermal energy storage medium 22 may be driven through the turbine using a one-way pump (not shown), either upstream (e.g., at node 8) or downstream from the turbine. Further embodiments of the method may comprise rejecting heat from the thermal energy storage medium 22 to the working fluid in the thermodynamic cycle/heat engine 130 in the heat exchanger 15' (and optionally in the heat exchanger 17') when discharging the thermal energy storage medium 22.

When the system 200 includes a valve in the conduit 13', the method may further comprise opening the valve in the conduit 13', or confirming that the valve in the conduit 13' is open, before discharging the thermal energy storage medium 22 from the high-temperature thermal energy storage tank 12. In addition, when the system 200 includes a vent or a valve in the high-temperature thermal energy storage tank 12, the method may further comprise confirming that the vent or valve in the high-temperature thermal energy storage tank 12 is closed, or closing the vent or valve in the high-temperature thermal energy storage tank 12, before discharging the thermal energy storage medium 22 from the high-temperature thermal energy storage tank 12.

Exemplary Methods of Storing and Retrieving Thermal Energy

The invention further concerns to a method of storing thermal energy, using the system 110 in FIG. 2, the system 200 in FIG. 3, or the system 300 in FIG. 4. This method may comprising storing a thermal energy storage medium 22 in a low-temperature energy storage tank 11, passing the thermal energy storage medium 22 through first and second gradient heat exchangers 15/15' and 17/17', compressing a working fluid (e.g., in the thermodynamic cycle or heat engine 130), passing the compressed working fluid through the first and second gradient heat exchangers 15/15' and 17/17', rejecting heat from the compressed working fluid to the thermal energy storage medium 22 in the first and second gradient heat exchangers 15/15' and 17/17', rejecting heat from the compressed working fluid to uncompressed working fluid in the second gradient heat exchanger 17/17', storing the heated thermal energy storage medium 22 in a high-temperature thermal energy storage tank 12, and exchanging heat between the working fluid and a heat source/sink (such as an external environment) at a substantially constant temperature. Rejecting heat from the compressed working fluid to the thermal energy storage medium 22 effectively heats the thermal energy storage medium 22 and cools the compressed working fluid. Exchanging heat between the working fluid and the heat source/sink at a substantially constant temperature effectively changes the phase of the working fluid (e.g., from supercritical to liquid).

Some embodiments of this method may further comprise adding a pressurized gas 24 to each of the low-temperature thermal energy storage tank 11 and the high-temperature thermal energy storage tank 12, then balancing the pressure of the gas 24 in the low-temperature and high-temperature thermal energy storage tanks 11 and 12. Such balancing may comprise opening the conduit 13/13' that is in fluid communication with both of the storage tanks 11 and 12.

In other or further embodiments of this method, rejecting heat from the compressed working fluid to the thermal energy storage medium 22 may comprise pumping the thermal energy storage medium 22 through the first and second gradient heat exchangers 15/15' and 17/17' using a pump (e.g., reversible pump 14), and/or driving a turbine (e.g., in the thermodynamic cycle or heat engine 130) with the cooled, compressed working fluid. Other aspects of the method of storing thermal energy may comprise or concern operations or functions of the systems 110, 200 and/or 300 described above.

The invention also concerns a method of retrieving energy, comprising storing the thermal energy storage medium 22 at the second, higher temperature in the high-temperature thermal energy storage tank 12, passing the thermal energy storage medium 22 through the first and second gradient heat exchangers 15/15' and 17/17', passing the working fluid through the first and second gradient heat exchangers 15/15' and 17/17', rejecting heat from the thermal energy storage medium 22 to the working fluid in the first and second gradient heat exchangers 15/15' and 17/17', thereby heating the working fluid and cooling the thermal energy storage medium 22, storing the cooled thermal energy storage medium 22 in the low-temperature thermal energy storage tank 11, expanding the heated working fluid (e.g., in the thermodynamic cycle/heat engine 130), rejecting heat from the expanded working fluid to compressed working fluid in the second gradient heat exchanger 17/17', and exchanging heat between the expanded working fluid and the heat source/heat sink at a substantially constant temperature, thereby changing the phase of the expanded working fluid (e.g., from gas to liquid).

Some embodiments of this method may further comprise balancing the pressure of the pressurized gas 24 in the high-temperature thermal energy storage tank is balanced with the pressurized gas 24 in the low-temperature thermal energy storage tank 11 using the conduit 13/13' (similar to the method of storing thermal energy), and recovering heat from the working fluid and/or the thermal energy storage medium 22 when discharging the system 110, 200 or 300. Other or further aspects of the method may further comprise driving a turbine with the cooled thermal energy storage medium 22 prior to storing the cooled thermal energy storage medium 22 in the low-temperature thermal energy storage tank 11. When driving the turbine, the method of retrieving energy may further comprise closing a valve in the conduit 13/13' before discharging the system 110, 200 or 300 (e.g., passing the thermal energy storage medium 22 through the first and second gradient heat exchangers 15/15' and 17/17').

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. An energy storage and retrieval system, comprising:

a high-temperature energy storage tank storing an energy storage medium at a first temperature;

one or more first pressure changing devices configured to transport the energy storage medium between the high-temperature energy storage tank and a source of the energy storage medium;

a first heat exchanger through which the energy storage medium passes, configured to exchange heat between the energy storage medium and a working fluid over a first temperature range; and a thermodynamic cycle containing the working fluid and having a high-pressure side and a low-pressure side, the thermodynamic cycle comprising:

a compressor/expander configured to change a pressure of the working fluid between the high-pressure side of the thermodynamic cycle and the low-pressure side of the thermodynamic cycle;

a second heat exchanger through which the energy storage medium and the working fluid pass, configured to (i) exchange heat between the energy storage medium and the working fluid over a second temperature range less than the first temperature range, (ii) transfer excess heat from the high-pressure side of the thermodynamic cycle to the low-pressure side of the thermodynamic cycle over the second temperature range and thus preheat the working fluid to be compressed by the compressor/expander when charging, and (iii) transfer heat from the working fluid expanded by the compressor/expander in the low-pressure side of the thermodynamic cycle to the high-pressure side of the thermodynamic cycle over the second temperature range when discharging, wherein the working fluid has a specific heat that is higher in the second temperature range than in the first temperature range, and all of the working fluid that passes through the second heat exchanger also passes through the first heat exchanger;

a substantially isothermal heat exchanger through which the working fluid passes, configured to exchange heat at a substantially constant temperature between the working fluid and the energy storage medium or an external environment, wherein the substantially isothermal heat exchanger is in fluid communication with the second heat exchanger, wherein the substantially constant temperature is less than both the first temperature and the second temperature; and one or more second pressure changing devices configured to transport the working fluid from the substantially isothermal heat exchanger to the second heat exchanger when the energy storage and retrieval system is discharging and from the second heat exchanger to the substantially isothermal heat exchanger when the energy storage and retrieval system is charging.

2. The energy storage and retrieval system of claim 1, wherein the source of the energy storage medium comprises a low-temperature energy storage tank storing the energy storage medium at a second temperature less than the first temperature and greater than the substantially constant temperature.

3. The energy storage and retrieval system of claim 2, wherein the high-temperature energy storage tank and the low-temperature energy storage tank have a pressurized gas therein, and the energy storage and retrieval system further comprises a first conduit fluidly connecting the pressurized gas in the low-temperature energy storage tank and the pressurized gas in the high-temperature energy storage tank.

4. The energy storage and retrieval system of claim 3, wherein the first conduit passes through at least the first heat exchanger, and the pressurized gas in the first conduit exchanges heat in the first heat exchanger with the energy storage medium and/or the working fluid.

5. The energy storage and retrieval system of claim 3, wherein the first conduit is configured to balance a first pressure in the high-temperature energy storage tank with a second pressure in the low-temperature energy storage tank.

6. The energy storage and retrieval system of claim 1, wherein the energy storage medium comprises water.

7. The energy storage and retrieval system of claim 1, wherein the working fluid comprises carbon dioxide.

8. The energy storage and retrieval system of claim 1, wherein the one or more first pressure changing devices comprises a first reversible pump.

9. The energy storage and retrieval system of claim 8, wherein the one or more second pressure changing devices comprises a second reversible pump.

10. The energy storage and retrieval system of claim 1, wherein the thermodynamic cycle comprises a trilateral cycle.

11. A thermal energy storage and retrieval system, comprising:

a low-temperature thermal energy storage tank storing a thermal energy storage medium at a first temperature and having a pressurized gas therein;

a high-temperature thermal energy storage tank storing the thermal energy storage medium at a second temperature higher than the first temperature and having the pressurized gas therein;

one or more first pressure changing devices configured to transport the thermal energy storage medium between the first low-temperature thermal energy storage tank and the high-temperature thermal energy storage tank;

a first heat exchanger through which the thermal energy storage medium passes, configured to exchange heat between the thermal energy storage medium and a working fluid;

a conduit (i) fluidly connecting the pressurized gas in the low-temperature thermal energy storage tank and the pressurized gas in the high-temperature thermal energy storage tank and (ii) passing through the first heat exchanger, wherein the pressurized gas in the conduit exchanges heat with the thermal energy storage medium and/or the working fluid; and a thermodynamic cycle comprising:

a second heat exchanger, configured to exchange heat between the working fluid and an external environment or a heat source/sink;

a compressor/expander in fluid communication with the first heat exchanger and directly or indirectly with the second heat exchanger, configured to change a pressure of the working fluid between the first heat exchanger and the second heat exchanger; and one or more second pressure changing devices between and in fluid communication with the first heat exchanger and the second heat exchanger, configured to transport the working fluid from the second heat exchanger to the first heat exchanger when the thermal energy storage and retrieval system is discharging and from the first heat exchanger to the second heat exchanger when the thermal energy storage and retrieval system is charging.

12. The thermal energy storage and retrieval system of claim 11, wherein the thermal energy storage medium comprises water.

13. The thermal energy storage and retrieval system of claim 11, wherein the second heat exchanger comprises a substantially isothermal heat exchanger.

14. The thermal energy storage and retrieval system of claim 11, further comprising one or more first valves configured to open and close the conduit.

15. The thermal energy storage and retrieval system of claim 14, further comprising one or more vents or second valves on each of the low-temperature thermal energy storage tank and the high-temperature thermal energy storage tank, configured to reduce a pressure of the pressurized gas in the respective low-temperature thermal energy storage tank or high-temperature thermal energy storage tank.

16. The thermal energy storage and retrieval system of claim 11, wherein when the thermal energy storage and retrieval system is discharging, the pressurized gas in the conduit recovers a first amount of heat from the thermal energy storage medium and/or the working fluid, the thermal energy storage medium loses a second amount of heat due to evaporation in the high-temperature thermal energy storage tank, and the first amount of heat offsets at least some of the second amount of heat.

17. The thermal energy storage and retrieval system of claim 11, wherein the thermodynamic cycle comprises a Brayton cycle, a Rankine cycle, a Stirling cycle, or a trilateral cycle.

18. A method of recovering heat when discharging a thermal energy storage medium stored in a high-temperature thermal energy storage tank, comprising:

pressurizing a gas in each of the high-temperature thermal energy storage tank and a low-temperature thermal energy storage tank in fluid communication with the high-temperature thermal energy storage tank, the high-temperature thermal energy storage tank storing the thermal energy storage medium at a first temperature, and the low-temperature thermal energy storage tank storing the thermal energy storage medium at a second temperature lower than the first temperature;

discharging the thermal energy storage medium from the high-temperature thermal energy storage tank to the low-temperature thermal energy storage tank;

passing the thermal energy storage medium through one or more heat exchangers between and in fluid communication with the high-temperature thermal energy storage tank and the low-temperature thermal energy storage tank when discharging the thermal energy storage medium; and passing the pressurized gas through a first conduit fluidly connecting the low-temperature thermal energy storage tank and the high-temperature thermal energy storage tank, wherein the first conduit passes through at least one of the one or more heat exchangers such that the pressurized gas in the first conduit exchanges heat with the thermal energy storage medium, thereby recovering at least some of the heat when the thermal energy storage medium is discharged.

19. The method of claim 18, wherein discharging the thermal energy storage medium comprises pumping the thermal energy storage medium from the high-temperature thermal energy storage tank to the low-temperature thermal energy storage tank.

20. The method of claim 18, further comprising rejecting heat from the thermal energy storage medium to a working fluid in a thermodynamic cycle in the one or more heat exchangers when discharging the thermal energy storage medium.

21. An energy storage and retrieval system, comprising:

a high-temperature energy storage tank storing an energy storage medium at a first temperature;

one or more first pressure changing devices configured to transport the energy storage medium between the high-temperature energy storage tank and a source of the energy storage medium;

a first heat exchanger through which the energy storage medium passes, configured to exchange heat between the energy storage medium and a working fluid over a first temperature range; and a thermodynamic cycle containing the working fluid and having a high-pressure side and a low-pressure side, the thermodynamic cycle comprising:

a compressor/expander configured to change a pressure of the working fluid between the high-pressure side of the thermodynamic cycle and the low-pressure side of the thermodynamic cycle;

a second heat exchanger through which the energy storage medium and the working fluid pass, configured to exchange heat between the energy storage medium and the working fluid over a second temperature range lower than the first temperature range, wherein the working fluid has a specific heat that is higher in the second temperature range than in the first temperature range;

a third heat exchanger configured to transfer heat over the second temperature range (i) from the high-pressure side of the thermodynamic cycle to the low-pressure side of the thermodynamic cycle and thus preheat the working fluid to be compressed by the compressor/expander when charging and (ii) from the working fluid expanded by the compressor/expander in the low-pressure side of the thermodynamic cycle to the high-pressure side of the thermodynamic cycle when discharging;

a substantially isothermal heat exchanger through which the working fluid passes, configured to exchange heat at a substantially constant temperature between the working fluid and the energy storage medium or an external environment, wherein the substantially isothermal heat exchanger is in fluid communication with the second and third heat exchangers; and one or more second pressure changing devices configured to transport the working fluid from the substantially isothermal heat exchanger to the second heat exchanger when the energy storage and retrieval system is discharging and from the second heat exchanger to the substantially isothermal heat exchanger when the energy storage and retrieval system is charging.

22. The energy storage and retrieval system of claim 21, further comprising:

a T-joint or a Y-joint between each of (i) the first heat exchanger and the second heat exchanger and (ii) the second heat exchanger and the one or more second pressure changing devices, first conduits between each of the T-joint(s) or the Y-joint(s) and the second heat exchanger, and second conduits between each of the T-joint(s) or the Y-joint(s) and the third heat exchanger, wherein:

each of the first conduits has a first cross-sectional area, each of the second conduits has a second cross-sectional area, and a ratio of the first cross-sectional area to the second cross-sectional area is equal to a ratio of an amount of heat transferred in the second heat exchanger to an amount of heat transferred in the third heat exchanger.

23. The energy storage and retrieval system of claim 21, wherein the energy storage medium is water, the isothermal heat exchanger comprises a low-temperature thermal energy storage tank that stores the water at a second temperature below the second temperature range, and the low-temperature thermal energy storage tank has a volume at least 5 times that of the high-temperature thermal energy storage tank.

* * * * *